United States Patent [19]

Hauser

[11] 4,346,830

[45] Aug. 31, 1982

[54] DISPENSER CARTON

[75] Inventor: Donald P. Hauser, Cincinnati, Ohio

[73] Assignee: The C. W. Zumbiel Company, Cincinnati, Ohio

[21] Appl. No.: 140,223

[22] Filed: Apr. 14, 1980

[51] Int. Cl.[3] ..... B26D 1/02

[52] U.S. Cl. ..... 225/49; 225/91

[58] Field of Search ..... 225/48, 49, 50, 91, 225/92, 89; 83/835, 661, 697, 856, 857

[56] References Cited

U.S. PATENT DOCUMENTS

| | | | |
|---|---|---|---|
| 2,766,877 | 10/1956 | Burbank | 225/91 X |
| 2,771,185 | 11/1956 | Annen | 225/91 X |
| 2,771,186 | 11/1956 | Burbank | 225/91 X |
| 3,193,427 | 7/1965 | Rogers | 225/49 X |
| 3,227,340 | 1/1966 | Haley | 225/48 X |
| 3,229,875 | 1/1966 | Stoller | 225/49 X |
| 3,281,036 | 10/1966 | Woodling | 225/91 X |
| 3,547,328 | 12/1970 | Bjorklund | 225/49 |
| 4,005,809 | 2/1977 | Finn | 225/49 |

*Primary Examiner*—Frank T. Yost

*Attorney, Agent, or Firm*—Wood, Herron & Evans

[57] ABSTRACT

A dispenser carton for dispensing sheet material, e.g., household wrap type sheet material. A unique structure at one corner of the carton permits tearing off a length of the sheet material after that length has been withdrawn from a roll inside the carton. The carton corner is comprised of plural serrated cutting sections each of which is cut through at least one of the panels, and plural fold sections which cooperate to connect the carton's walls together at that corner, the serrated and fold sections alternating along the corner's length from one end to the other. The serrated sections are of a length and number to permit tearing of the sheet material to desired length on that carton corner, and the fold sections are of a length and number to provide structural rigidity to the carton at that corner during normal use of the tearing edge and carton so formed.

19 Claims, 6 Drawing Figures

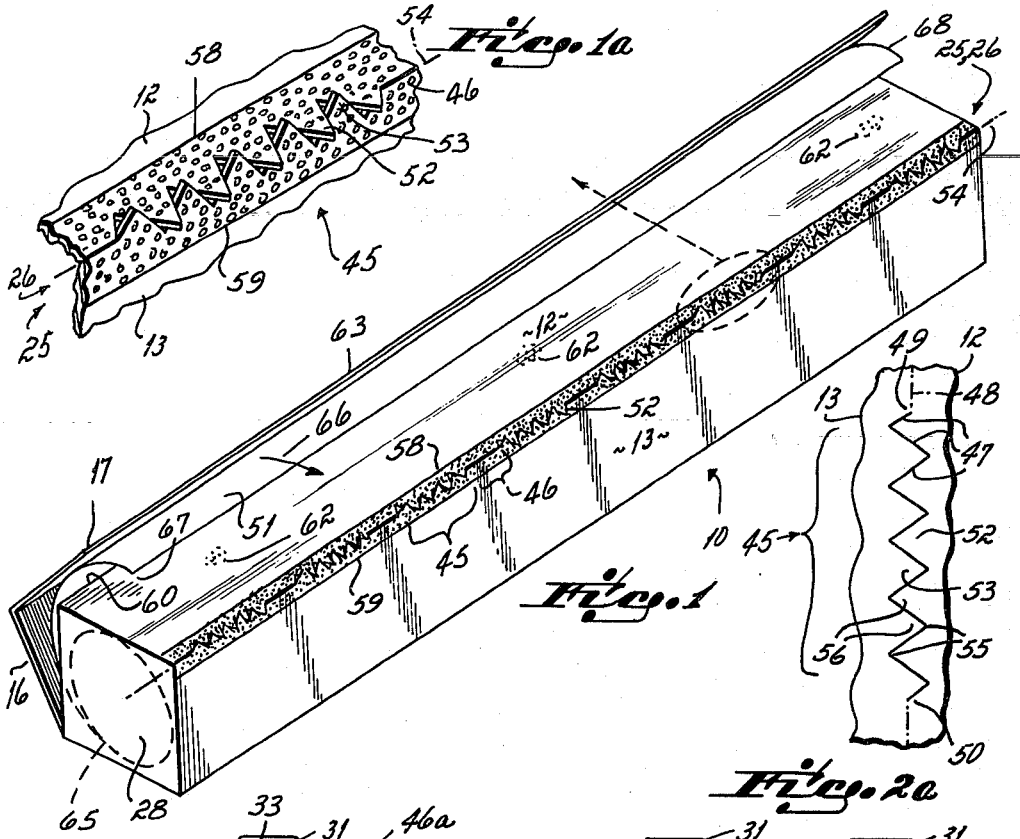
Fig. 1a
Fig. 1
Fig. 2a
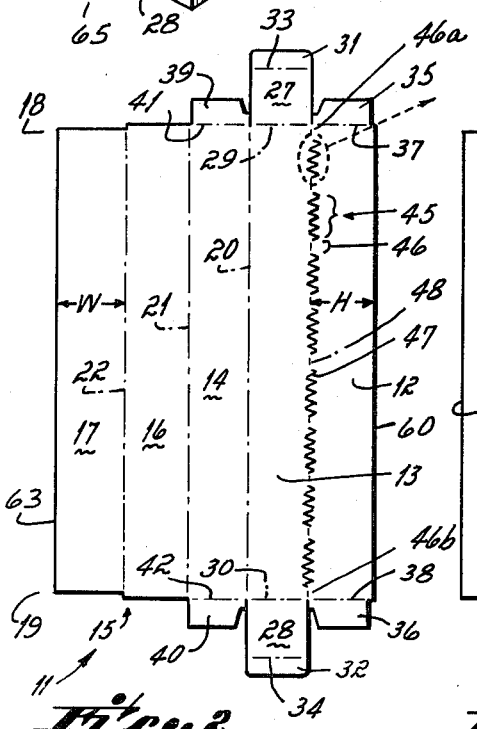
Fig. 2
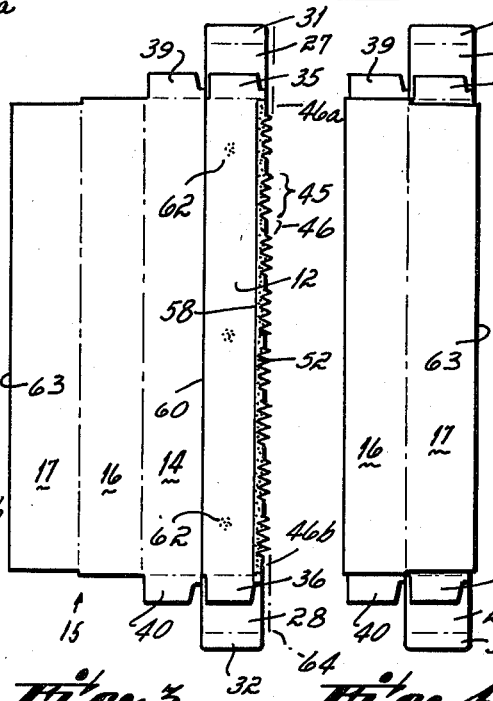
Fig. 3
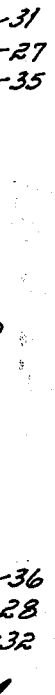
Fig. 4

DISPENSER CARTON

This invention relates to dispenser cartons. More particularly, this invention relates to a dispenser carton having a novel and unique cutting edge structure.

Dispenser cartons for sheet material are, of course, very well known to the prior art. One very wide spread use for such dispenser cartons is in the marketing of household wrap type sheet material. This type sheet material is commonly used in the home for protecting foodstuffs. Typically, household wrap type sheet material is sold in roll form, the roll being positioned in a dispenser carton that is sealed during distribution of the product from manufacturer to consumer. The dispenser carton also incorporates a tearing or cutting edge in the carton structure. In use, and as a consumer withdraws a desired length of sheet material from the carton, the sheet is positioned to overlie the carton's cutting edge and is torn from one edge of the sheet to the other through use of that cutting edge from the continuous length left on the roll. Typical of such consumer type sheet materials marketed through use of roll dispenser cartons are wax paper, aluminum foil, freezer paper, and various polymeric films. The polymeric films include, for example, polyethylene film and film produced from a copolymer of vinylidine chloride and vinyl chloride.

It is very well known to the prior art to incorporate a cutting or tearing edge structure with a roll dispenser carton. Perhaps the most widely used structure to-date from a commercial standpoint makes use of a separate metal blade having a serrated edge along one edge of that blade from one end to another. This metal strip is attached to a paperboard dispenser carton at, for example, the front wall/floor corner thereof so that the serrated edge extends slightly beyond that corner. This permits the carton's user to easily tear sheet material, unrolled from within that carton, along the serrated edge at the length desired. However, this metal serrated blade or strip has a couple of disadvantages from a commercial use standpoint. One disadvantage is that a metal serrated blade may pose a potential safety problem to a careless user in that the user's fingers may be inadvertently cut. Another disadvantage is that a metal serrated blade may scratch or otherwise damage wood or metal items in the user's home. Further, the use of a separate metal blade that must be separately attached to the carton constitutes an additional part in the carton's structure which, of course, adds to the manufacturing cost of the carton. In addition, and with a metal strip or blade attached to a paperboard carton, some cartons tend to warp because of the difference in expansion coefficients between metal and paperboard, and this may cause problems in gluing and erecting of the carton blanks, and/or filling of erected cartons with rolls of sheet material. A typical prior art disclosure of a dispenser carton with metal serrated tearing edge is illustrated in U.S. Pat. No. 1,364,743.

In recent years there have been attempts to develop dispenser cartons for the marketplace that have a tearing or cutting edge which does not incorporate a separate metal blade or strip. Such attempts have met with varying degrees of success, but to the best of my knowledge at the present time dispenser cartons with metal tearing edges for household wrap type sheet material still dominate the dispenser carton market directed to such sheet materials. In that type of dispenser carton where the cutting edge structure is located at the carton's front wall/floor corner, one attempt comprises an abrasive material applied to the carton's front wall, or to the carton's front wall and floor, at the front wall/floor corner from one end to the other of the carton. This abrasive strip is comprised of a granular abrasive material that is pulled angularly against that corner. But much abrasive cutting edge structures have not seen widespread commercial acceptance. Such carton structures are illustrated in U.S. Pat. Nos. 2,888,181 and 3,942,417.

Accordingly, it has been one objective of this invention to provide an improved dispenser carton having a novel cutting edge structure located at a carton corner defined by two panels of that carton, that cutting edge being structured from those two panels at that corner.

It has been another objective of this invention to provide a novel and improved cutting edge structure located at the corner of adjacent panels foldably connected one to the other particularly when those panels are fabricated from paperboard or the like, that cutting edge structure being defined from at least one of those two panels at that corner and not from additional panels or blades attached thereto.

In accord with these objectives, the novel cutting edge of this invention, in preferred form, is incorporated in a novel dispenser carton for dispensing sheet material, e.g., household wrap type sheet material. One corner of the carton is comprised of plural serrated cutting sections each of which is cut through at least one of the panels, and plural fold sections which cooperate to connect the panels together at that corner, the serrated and fold sections alternating along the corner's length from one end to the other. The serrated sections are of a length and number to permit tearing of sheet material to desired length on that corner, and the fold sections are of a length and number to provide structural rigidity to the panels at that corner during normal use of a structure that incorporates the tearing edge so formed. This unique structure is preferably located at one corner of the carton to permit tearing off a length of the sheet material after that length has been withdrawn from a roll inside the carton.

Other objectives and advantages of this invention will be more apparent from the following detailed description taken in conjunction with the drawings in which:

FIG. 1 is a roll type dispenser carton for household wrap type sheet material that incorporates a novel cutting edge in accord with the principles of this invention;

FIG. 1*a* is an enlarged fragmentary view of the encircled area of FIG. 1;

FIG. 2 is a top plan view of a carton blank from which the erected carton of FIG. 1 is assembled;

FIG. 2*a* is an enlarged fragmentary view of the encircled area of FIG. 2;

FIG. 3 is a top view similar to FIG. 2 but illustrating the blank in a preliminary fold position during assembly of the carton; and FIG. 4 is a top view similar to FIG. 3 after assembly of the blank with the carton shown in knock-down or collapsed configuration.

The dispenser carton 10 in accord with the principles of this invention, and the blank 11 from which the carton is fabricated, as shown in FIGS. 1 and 2, is preferably formed from paperboard. The carton 10 and blank 11 are comprised of a series of panels which include front wall 12, bottom wall or floor 13, rear wall 14, and closure panel 15 comprised of top wall 16 and main closure flap 17. The floor 13, rear wall 14, top wall 16, and main closure flap 17 are connected one to the other integrally from one end edge 18 of each of those panels to the other end edge 19 of each of those panels at score or fold lines 20–22, respectively. In other words, the floor 13, rear wall 14, top wall 16 and main closure flap 17 are all integral one with the other at the carton's corner 20–22 between ends 18, 19 of that carton 10, those panels 13, 14, 16, 17 merely being folded relative one to the other at those corners. The front wall 12, however, is connected to the floor 13 at carton corner 25 by a unique and novel cutting edge structure 26, the specifics of which are described in detail below. The carton 10 and carton blank 11 also includes end walls 27, 28 connected to opposite ends of the floor 13 along score or fold lines 29, 30, respectively, and each end wall has an end closure flap 31, 32 connected thereto along fold lines 33, 34, respectively. Each end of the front wall 12 has a front tuck flap 36, 36 connected thereto along fold lines 37, 38, respectively, and each end of the rear wall 14 has a rear tuck flap 39, 40 connected there to along fold lines 41, 42, respectively.

The novel and unique tearing or cutting edge structure 26 is illustrated in blank form in FIGS. 2 and 3, and in erected or use form in FIG. 1. The cutting edge structure 26 is positioned, in the carton 10 embodiment shown, at the front wall 12/floor 13 corner of the carton. The cutting edge 26 is comprised of plural serrated cutting sections 45 separated by plural fold sections 46, these sections being disposed generally in line one with another. The serrated cutting sections 45 are defined by cut lines 47 which extend completely through, i.e., which are cut completely through, the panels 12, 13 of the paperboard blank 11. The fold sections 46 are defined by fold lines 48 which, in effect, are merely score lines set into the paperboard blank 11. Note particularly that each serrated section 45 merges into a fold section 46 at each of its ends 49, 50. This results in a fold section 46*a*, 46*b* at each end of the carton's corner 25, and also results in a fold section 46 between adjacent serrated sections 45. The plurality of fold sections 46 is of a number, and each fold section is of a length, so as to provide substantial structural rigidity to the adjacent panels, 12, 13 of the carton 10 when it is in erected and fully assembled form as shown in FIG. 1. In other words, and because the carton's front wall/floor corner 25 is fully severed or cut through at spaced locations along its length, i.e., is fully severed throughout the length of each serrated section 45, the plural fold sections 46 must be of such number and of such length as to maintain substantial structural rigidity between the foldably joined front wall 12 and floor 31 when the dispenser carton 10 is used in normal fashion for its intended end use as a carton and when the cutting edge structure 26 is used in normal fashion for tearing sheet material 51 thereon. Further, it is important that the plural serrated sections 45 at that corner 25 be of such number, and that each serrated section be of such length, as to permit tearing of sheet material 51 on that corner that is withdrawn from a roll thereof inside the carton. This is important, of course, because the end use of the cutting edge structure 26 is for tearing or severing a desired length of sheet material 51 that is withdrawn from the dispenser carton 10.

Each serrated cutting section 45 defines a cutting edge in the form of a series of teeth 52, 53 defined from the carton's floor panel 13 and the front wall panel 12, respectively. The teeth 52 integral with the front wall 12 extend beyond phantom corner line 54 defined by fold sections 46 since same are partially cut out of the floor 13, and the teeth 53 in floor 13 also extend beyond phantom corner line 54 since same are partially cut out of the front wall 12, when the carton 10 is erected as shown in FIG. 1. This results in a root 55 of each tooth 52 or 53 being on one side of corner line 54 and the points 56 of each tooth 52 or 53 being on the other side of the corner line 54, the pitch line of the teeth generally coinciding with the corner line. In other words, and when the carton 10 is in the blank 11 configuration shown in FIG. 2, the cutting edge or teeth 53 of each serrated section 45 integral and coplanar with the floor panel 13 extend outwardly beyond the front wall/floor corner fold line 48 of that front panel into the front wall panel 12, and the cutting edge or teeth 52 integral and coplanar with the front wall panel 12 extend outwardly beyond the front wall/floor corner fold line 48 of that front wall panel into the floor panel 13. As a result, when the carton blank 11 is erected as shown in FIG. 1, there are serrated teeth 53 that extend outwardly of, i.e., slightly beyond, front wall/floor corner edge 54 of the carton 10 while remaining generally in the plane of the floor 13 since those teeth 53 are integral with the floor, and there are teeth 52 which extend outwardly of, i.e., slightly beyond, the front wall/floor corner edge 54 while remaining generally in the plane of the front wall 12 since those teeth 52 are integral with the front wall. This, in effect, provides a double serrated edge for each serrated section 45 at the front wall/floor corner 25 of the dispenser carton 10 when the blank is erected into carton configuration.

The relative size of the serrations or teeth 52, 53, the length of the serrated sections 45, and the length of the fold sections 46, is shown in relative fashion in FIG. 2 when the dispenser carton 10 is to be used for dispensing a polymeric film, e.g., a copolymer film of vinylidine chloride and vinyl chloride, or a polyethylene film, such as is commonly used for household wrapping of foodstuffs and the like, and where the paperboard is of usual thickness for that type carton end use. In this regard, it will be noted that each serrated section 45 is of a length about equal to 9% of the total length of the carton's cutting edge 26, and that each fold section is of a length about 3% of the length of the carton's cutting edge. It is preferred that the total length of all serrated sections 45 that make up the cutting edge 26 be no greater than about 85% of that cutting edge's length, and that the total length of all fold sections that make up the cutting edge 26 be no greater than about 15% of that cutting edge's length. Further, it is preferred in use that the length of each serrated section 45 not exceed about 5%, and that the length of each fold section 46 not exceed about 40%, of the total length of the carton's cutting edge 26 in a roll dispenser carton used for household wrap type sheet material.

An abrasive strip 58 is coated on the front wall 12 at the corner 25 of that front wall with the floor 13 from one end edge 18 of the wall to the other end edge 19. This front wall abrasive strip 58 or coating covers the serrated teeth 52 integral with the front wall 12, and extends toward the top edge 60 of that front wall a distance about two times the pitch depth of the teeth 52 as measured from the roots 55 of the teeth and as shown in FIG. 1*a*. An abrasive strip 59 also is coated on the floor 13 at the front wall 12/floor corner from one edge 18 to the other edge 19 of the floor. This floor abrasive strip covers the serrated teeth 53 integral with the floor, and extends toward the back edge 20 of that floor a distance about two times the pitch depth of the teeth 53. The abrasive in these abrasive strips 58, 59 may be any conventional granular abrasive such as alumina, sand, silicon carbide, or the like. The abrasive is preferably adhered or retained in coated relation with the carton's front wall through use of a liquid carrier of a viscosity that permits a suspension of the abrasive to be roll coated on the paperboard blank 11.

Assembly of the blank 11 is illustrated in FIGS. 2–4 from the blank configuration into the fabricated but knock-down configuration. As shown in FIG. 3, the blank of FIG. 2 is initially folded into a preliminary position so that the front wall 12 panel overlies the floor 13 panel, i.e., is folded about the corner fold line 48 of the front wall/floor corner 25. In this attitude, the inside face of the front wall 12 overlies the inside face of the floor 13 in facial contact therewith. This intermediate or preliminary fold position exposes the exterior front wall/corner edge of the front wall 12 and floor 13 panels to roll coating of those edges with the abrasive coating strips 58, 59. As earlier noted, the abrasive strips 58, 59 are coated on the exterior faces of the front wall 12 and floor 13, including the serrated teeth 52, 53 integral with and part of the front wall 12 and floor 13, at those panel 12, 13 edges adjacent corner 25, as shown in FIGS. 1 and 3. Coating of abrasive strips 58, 59 on both front wall 12 and floor 13 tends to prevent undesirable warping of these panels relative one to the other at the front wall/floor corner 25 when the blank is in the blank configuration, and the assembled knocked down figuration shown in FIG. 4 and the erected configuration shown in FIG. 1.

After the abrasive strips 58, 59 have beeen coated onto the front wall 12 and floor 13 panels of the blank 11, the closure panel 15 of the blank, i.e., the top wall 16 panel and main closure flap 17 of the blank, are folded about the rear wall/top wall corner 21 of the blank until the inside face of the main closure flap overlies the outside face of the front wall 12 panel in facial contact therewith, see FIG. 4. Prior to such a fold step, however, glue is introduced at spots 62 to the front wall's outside face so that when the closure flap 17 is folded onto overlying relation with that front wall the closure flap will be glued thereto. With the main closure flap 17 glued to the carton's front wall 12, note that the width W of that main closure flap is somewhat greater than the height H of the front wall 12, thereby causing the bottom edge 63 of the main closure flap to extend slightly beyond or overlie phantom line 64 that includes the tips of points of the serrated teeth 52 integral with that front wall. This structural relation of the main closure flap 17 with the front wall's serrated teeth 52 tends to protect those teeth, as well as the floor's teeth 53, when the carton 10 is in knocked-down configuration, as well as when the carton is erected into use configuration and filled with a roll 65 of sheet material 51 (but prior to opening of that carton 10 for dispensing the sheet material by a consumer). This protection tends to prevent the teeth 52, 53 from being significantly disfigured or otherwise rendered useless as a cutting edge during storage of the knocked-down carton 10, and during distribution of the container 10 from the sheet material manufacturer through wholesale and retail outlets to the consumer.

The blank 11 configuration shown in FIG. 4 is the final folded and glued position of the blank, the carton so formed being in knock-down or collapsed configuration. In this configuration the carton may be shipped from the carton manufacturer to the sheet material manufacturer for packaging of sheet material on rolls 65 in that carton. When such packaging is desired, the carton is set-up by erecting same into a tubular configuration from the flat or knock-down configuration shown in FIG. 4, and by closing the carton's ends through use of tuck flaps 35, 36, 39, 40, end walls 27, 28 and end closure flaps 31, 32 after a roll 65 of sheet material 51 is inserted into the tubular carton. This, of course, makes the fully erected and closed carton 10, with a roll of sheet material therein, available for distribution to the consumer.

In use of the dispenser carton 10 by the consumer, when the roll 65 filled carton is first received it is opened simply by prying the main closure flap 17 away from the carton's front wall 12, i.e., by breaking adherence provided by glue spots 62, thereby permitting the top wall 16 and flap 17 to be pivoted from a full closure position to an open position along fold line 21 at the top edge of the carton's rear wall 14. This, of course, allows the sheet material 51 to be withdrawn from the carton (in the direction shown by arrow 66) while retaining the roll 65 in the carton. With the desired length of sheet material 51 withdrawn by the carton's user, main closure flap 17 is tucked inside the carton's front wall, i.e., the carton 10 is closed, and the sheet material is caused to overlie the front wall/floor corner 25 of the carton. The sheet material 51 is thereafter torn or cut in the usual tearing fashion from one end 18 of the carton 10 to the other 19, the serrated sections 45 cooperating to provide, in effect, a cutting edge 26 from one edge of the carton to the other. The abrasive strips 58, 59 cooperate with the novel cutting edge 26 to tend to enhance the cutting action provided to the sheet material across the cutting corner edge 26 as the sheet material is being cut or torn from one edge 67 to the other 68 across the carton's cutting edge. Also, the abrasive strip 58 cooperates with the novel cutting edge 26 to provide a snubbing type action that tends to aid in preventing substantial longitudinal dislocation or displacement of the sheet material (in the direction shown by arrow 66) across the cutting edge as the sheet material is being cut or torn from one edge 67 to the other 68 across that carton's cutting edge. The fold sections 46 interposed between the serrated sections 45 at corner 25 cooperate to maintain structural integrity between the front wall 12 and floor 13 at the front wall/floor corner 25 during erection of the carton 10 for loading with the rolled sheet material 51, during shipment of the final packaged product to the consumer, and during use of the package as a storage carton by the consumer until the sheet material on the support roll is exhausted. Of course, the fold sections 46 also cooperate with front wall 12 and floor 13 to provide substantial structural rigidity to the cutting edge structure 26 at the front wall/floor corner 25 when sheet material 51 is torn along that corner 25 from one end 17 to the other end 18.

Having described in detail the preferred embodiment of my invention, what I desire to claim and protect by Letter Patent is:

1. A carton comprising two adjacent panels joined one to the other at a corner, said panels being formed from a one-piece blank, said panels being angularly disposed relative one to the other to define a phantom corner line at said corner, a fold section located at said corner of said panels, said fold section being defined by a score line in said one-piece blank, and a cutting section located at said corner of said panels, said cutting section and said fold section being positioned generally in line one with another, said cutting section being formed from one of said panels by a cut line which extends completely through said one panel, said cutting section remaining integral with the other panel from which said cutting section was not formed, and said cutting section extending outwardly from said other panel beyond said phantom corner line.

2. A carton as set forth in claim 1, said cutting section being serrated along its length, the teeth of said serrated section at least partially extending beyond said phantom corner line.

3. A carton as set forth in claim 1, said cutting section being partially defined by one of said panels and partially defined by the other of said panels, that portion of said cutting section defined by one panel at least partially extending beyond the phantom corner line defined by said fold section, and that portion of said cutting section defined by the other panel also at least partially extending beyond the phantom corner line defined by said fold section.

4. A carton as set forth in claim 3, said cutting section being serrated along its length, the teeth of said serrated section at least partially extending beyond said phantom corner line.

5. A carton as set forth in claim 3, said panels comprising two walls of said carton, said walls being held immobile relative one to the other when said carton is erected and in a storage configuration.

6. A carton as set forth in claim 5, said walls comprising a front wall and floor of said carton.

7. A carton as set forth in claim 6, said closure comprising a main closure flap adapted to overlie said carton's front wall, said main closure flap being of a width slightly greater than the height of said carton's front wall, said closure flap thereby being adapted to overlie said front wall/floor corner when said main closure flap is retained in closure relation with said front wall.

8. A carton as set forth in claim 1, said corner comprising plural cutting sections and plural fold sections, and said cutting sections being separated one from the other by one fold section.

9. A carton as set forth in claim 8, said fold sections being of a number, and each of said fold sections being of a length, sufficient to provide structural rigidity to said carton panels at said corner during normal use of said carton in the manner for which it is intended.

10. A carton as set forth in claim 9, said cutting sections being of a number, and each of said cutting sections being of a length, sufficient to permit tearing on said corner of sheet material retained in that carton upon withdrawal of that material from said carton.

11. A carton as set forth in claim 10, said cutting section comprising not more than about 85% of the total length of said corner and said fold sections comprising not less than about 15% of the total length of said corner.

12. A carton as set forth in claim 10, each of said cutting sections comprising not less than about 5% of the total length of said corner and each of said fold sections comprising not more than about 40% of the total length of said corner.

13. A carton as set forth in claim 10, said carton comprising an abrasive coated on at least one of said panels adjacent said corner.

14. A carton comprising two adjacent panels joined one to the other at a corner, said panels being angularly disposed relative one to the other to define said corner, and a cutting section and a fold section located at said corner of said panels, said cutting section and said fold section being positioned generally in line one with another, said cutting section at least partially extending outwardly from said panels beyond the phantom corner line defined by said fold section, said cutting section being partially defined by a cut line which extends completely through one of said panels and partially defined by a cut line which extends completely through the other of said panels, that portion of said cutting section defined by said one panel at least partially extending beyond the phantom corner line defined by said fold section, and that portion of said cutting section defined by said other panel also at least partially extending beyond the phantom corner line defined by said fold section.

15. A carton as set forth in claim 14, said cutting section being serrated along its length, the teeth of said serrated section at least partially extending beyond said phantom corner line.

16. A carton as set forth in claim 14, said corner comprising plural cutting sections and plural fold sections, and said cutting sections being separated one from the other by one fold section.

17. A carton as set forth in claim 16, said fold sections being of a number, and each of said fold sections being of a length, sufficient to provide structural rigidity to a carton fabricated from said panels at said corner during normal use of said carton in the manner for which it is intended, and said cutting sections being of a number, and each of said cutting sections being of a length, sufficient to permit tearing on said corner of sheet material retained in that carton upon withdrawal of that material from said carton.

18. A carton as set forth in claim 14, said panels comprising two walls of said carton, said walls being held immobile relative one to the other when said carton is erected and in a storage configuration.

19. A carton as set forth in claim 14, said carton comprising an abrasive coated on at least one of said panels adjacent said corner, said abrasive also being coated on that part of said cutting section extending beyond the phantom corner line.

* * * * *